US005765632A

United States Patent [19]

Gire

[11] Patent Number: 5,765,632

[45] Date of Patent: Jun. 16, 1998

[54] PLATE-TYPE HEAT EXCHANGER, IN PARTICULAR AN OIL COOLER FOR A MOTOR VEHICLE

[75] Inventor: Hèléne Gire, Asnieres, France

[73] Assignee: Valeo Thermique Moteur, Le Mesnil-Saint-Denis, France

[21] Appl. No.: 343,632

[22] Filed: Nov. 22, 1994

[30] Foreign Application Priority Data

Nov. 23, 1993 [FR] France ..... 93 14005

[51] Int. Cl.[6] ..... F28F 3/08

[52] U.S. Cl. ..... 165/167; 165/916; 165/DIG. 471

[58] Field of Search ..... 165/167, 916; 123/196 AB; 184/6.22, 104.3

[56] References Cited

U.S. PATENT DOCUMENTS

| | | | |
|---|---|---|---|
| 4,271,901 | 6/1981 | Buchmuller | 165/916 X |
| 4,561,494 | 12/1985 | Frost | 165/167 X |
| 5,014,775 | 5/1991 | Watanabe | 165/167 |
| 5,146,980 | 9/1992 | Le Gauyer | 165/167 |
| 5,154,225 | 10/1992 | Armbruster et al. | 165/167 X |
| 5,203,832 | 4/1993 | Beatenbough et al. | 165/167 X |

FOREIGN PATENT DOCUMENTS

| | | | |
|---|---|---|---|
| 492047 | 7/1992 | European Pat. Off. | 165/916 |
| 107097 | 4/1989 | Japan | 165/916 |
| 283399 | 10/1992 | Japan | 165/916 |

*Primary Examiner*—Leonard R. Leo
*Attorney, Agent, or Firm*—Morgan & Finnegan, LLP

[57] ABSTRACT

A plate type heat exchanger, for effecting heat transfer between a first fluid and a second fluid, comprises a casing through which the second fluid flows, together with a stack of plates arranged in pairs alternately within the casing and along a stacking axis. The plates of each pair define between them a flow passage for the first fluid. Each plate has two communication apertures formed through it, to enable the first fluid to flow between the successive pairs of plates. Perturbator elements are arranged in these flow passages for perturbing the flow of fluid in the latter. Each plate is substantially square, with its communication apertures being aligned with each other in an alignment direction parallel to two sides of the square. Each perturbator element comprises lines of corrugations which extend in a direction at right angles to the alignment direction. The invention is applicable especially to oil coolers for motor vehicles.

10 Claims, 4 Drawing Sheets

FIG. 4
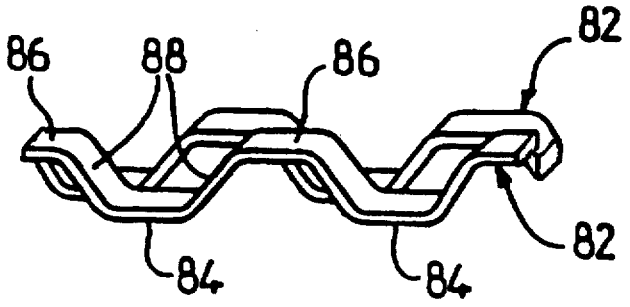
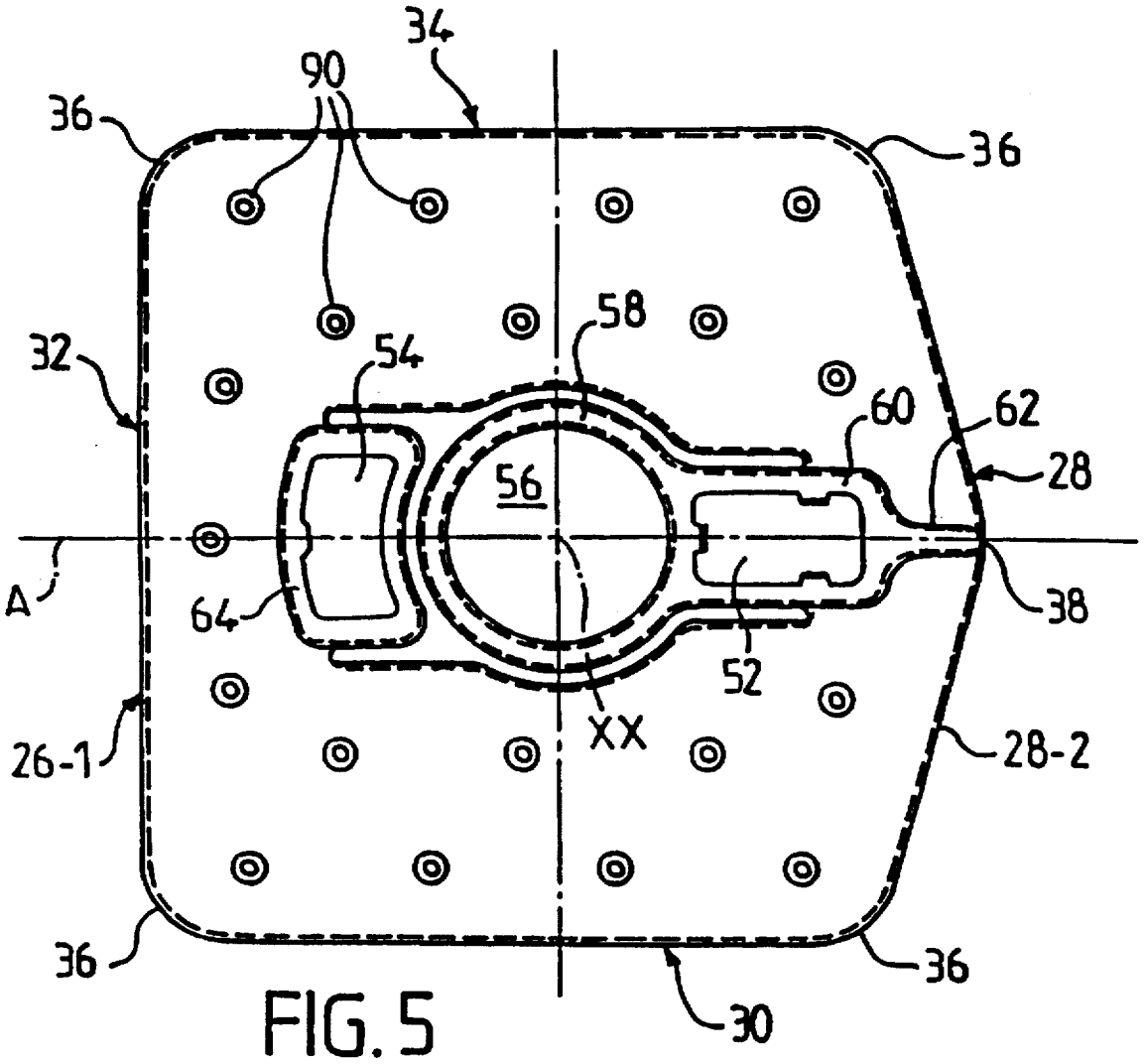
FIG. 5

PLATE-TYPE HEAT EXCHANGER, IN PARTICULAR AN OIL COOLER FOR A MOTOR VEHICLE

FIELD OF THE INVENTION

This invention relates to plate type heat exchangers for effecting heat transfer between two fluids, and applicable in particular for the cooling of lubricating oil, that is to say engine oil and/or gearbox oil, in motor vehicles.

BACKGROUND OF THE INVENTION

It is known, in particular from the specification of published European patent application EP 0 428 919A, to provide a plate type heat exchanger for effecting heat transfer between a first fluid, for example an oil to be cooled, and a second fluid, for example a coolant liquid, the heat exchanger comprising:

- a casing arranged for the second fluid to pass through it;
- a stack of plates arranged in pairs alternately within the casing and defining a stacking axis, in such a way that the plates of any one said pair delimit between them a flow passage for the first fluid;
- two communication apertures formed through each said plate for permitting the flow of the first fluid between the successive pairs of plates from an inlet for the first fluid to an outlet for the first fluid; and
- perturbator elements mounted within the flow passages for the first fluid.

In known heat exchangers of this type, the plates normally have the general form of a disc. This is formed with a circular peripheral lip and a circular internal lip, which is arranged to surround a central tube, around which the pairs of plates are stacked. When the mating lips of two plates, in facing relationship with each other and forming part of a common pair, are joined together, for example by brazing, the two plates of the pair define an annular flow passage between them for flow of the first fluid, such as oil.

The two communication apertures formed through each plate serve as an inlet and an outlet respectively for the first fluid. Each of these two apertures is bounded by a lip which is arranged to be sealingly joined to a matching lip of an adjacent plate.

A heat exchanger of this type is used most particularly for the cooling of lubricating oil received from an engine block. The central tube around which the disc-shaped plates are stacked receives an internal threaded rod. This latter serves firstly for fastening the heat exchanger on to the engine, and secondly for securing an oil filter on to the heat exchanger itself. This hollow central tube also forms the return path for returning the oil to the engine, either directly within the tube itself or through the threaded rod, the latter being then made hollow for this purpose. In addition, such known heat exchangers commonly include a bypass port which is provided with a flap valve. This flap valve is normally open when the oil is cold and viscous, but closed when the oil is hot and fluid.

When the oil is cold and viscous, with the flap valve then being open, the oil then passes directly through the heat exchanger from the oil inlet of the heat exchanger to the bypass port, via the inlet apertures of the plates in the stack, so that it reaches the filter direct and returns to the motor through the central tube or hollow central rod. When, on the other hand, the oil is hot and fluid, the flap valve being closed, the oil is distributed into each flow passage between the plates of the various pairs, through the inlet openings of the plates. It leaves each flow passage through the outlet apertures formed in the plates, so as to reach a passage which communicates with the filter. The return of the oil to the engine is again via the central tube or hollow central rod, the oil having been cooled by heat exchanger with the first fluid, that is to say the coolant liquid which flows through the casing.

In the known heat exchangers of the above type, the flow perturbating elements are components in the form of discs, each of which is mounted in the space defined between the two plates of a pair in the stack. These plates are formed with reliefs in the form of fins or the like, which perturb the flow of the oil within the plates, so as to improve heat transfer. However, it has been found that in the case of circular plates and perturbator elements, the flow of the oil within each flow passage in a pair of plates is retarded by the projecting portions of the perturbator element. In particular, the oil has difficulty in flowing over the fin-shaped reliefs of the perturbator elements, especially in the region of the periphery of the plates.

Another drawback of the heat exchangers in the prior art lies in the fact that the communication apertures formed through each plate are usually circular, or alternatively of another curved shape (as to which, see for example European patent specification EP 0 428 919A). As a result, the oil escapes tangentially through the inlet aperture, and does not make proper contact with the projecting portions or fins of the perturbator elements.

In addition, in the known heat exchangers of this type, the casing is usually provided with an inlet tube branch and an outlet tube branch for the second fluid, these being situated close to each other on the side wall of the casing. The two tube branches are then open respectively into two adjacent compartments which are formed between the side wall of the casing and the stack of plates. The compartment which is connected to the inlet tube branch enables the first fluid to be admitted simultaneously into the spaces which are defined between the pairs of plates, while the compartment which is connected to the outlet tube branch enables the second fluid to leave the said spaces simultaneously.

To this end, it is necessary to provide particular arrangements on the plates in order to ensure sealing between the stack of plates and the side wall of the casing on which the two tube branches are fixed. Up to the present time, manufacture of such an arrangement has been particularly complicated.

DISCUSSION OF THE INVENTION

A main object of the invention is to overcome the above mentioned drawbacks.

According to the invention, a plate type heat exchanger, for effecting heat transfer between a first fluid, for example an oil to be cooled, and a second fluid, for example a coolant liquid, in which the heat exchanger comprises:

- a casing arranged for the second fluid to pass through it;
- a stack of plates arranged in pairs alternately within the casing and defining a stacking axis, in such a way that the plates of any one said pair delimit between them a flow passage for the first fluid;
- two communication apertures formed through each said plate for permitting the flow of the first fluid between the successive pairs of plates from an inlet for the first fluid to an outlet for the first fluid; and
- perturbator elements mounted within the flow passages for the first fluid, is characterised in that each plate is substantially square, in that the two communication apertures of each plate are arranged on either side of the stacking axis and lie in an alignment direction parallel to two sides of the square, and in that each perturbator element comprises corrugation lines in the form of fins which extend in a direction parallel to the alignment direction of the apertures in the plates.

A result of this arrangement is that the first fluid (for example oil), which penetrates into the flow passage defined by a pair of plates, is able to be in full contact with the perturbator element and to fill the whole of the space defined between the two plates. In particular, the first fluid is able to reach the periphery of both the perturbator and the flow passage.

Although it is true that square heat transfer plates have been proposed in the past, these have had conventional perturbator elements, so that it has not been possible to achieve the advantage obtained by the present invention.

According to another feature of the invention, the corrugations comprise flat segments which are joined in pairs through an obtuse angle.

Preferably, the corrugations in two adjacent corrugation lines are staggered with respect to each other.

Each perturbator element is preferably in the form of a pressed component of generally square form, having a central aperture of elongated form. This elongated central aperture not only accommodates the central tube of the heat exchanger, but also provides communication between the communication apertures of the various plates.

According to a preferred feature of the invention, the two communication apertures in each plate have a square or rectangular shape having sides which are generally parallel to the sides of the plate. In this way, the first fluid entering into the interior of a pair of plates escapes in directions which are parallel or at right angles to the corrugation lines, which facilitates flow of the fluid.

In a preferred embodiment of the invention, one of the communication apertures in each plate, which serves for entry of the first fluid, has a square form, while the other communication aperture, which serves as the outlet for the first fluid, is rectangular in shape, with the larger dimension of the rectangle extending transversely to the alignment direction of the two communication apertures.

Preferably, the casing has a transverse cross section which is substantially square, and which is bounded by four flat lateral faces which are substantially rectangular.

According to another preferred feature of the invention, one of the four lateral faces of the casing serves as an attachment face, and is provided with an inlet tube branch and an outlet tube branch for the second fluid, with the two tube branches being open respectively into two symmetrical portions of the attachment face which extend on either side of a median line which is parallel to the stacking axis. The median line thus defines the boundary between two compartments, into which the two said tube branches are open respectively.

According to a further preferred feature of the invention, each said plate has, on the same side as the attachment face, a non-rectilinear front edge comprising two straight portions joined together through an obtuse angle, the apex of which abuts against the attachment face at the level of the median line of the latter. This feature defines the two compartments, mentioned above, within the casing.

Preferably, each said plate of the stack has a boss which extends outwardly and in the alignment direction of the communication apertures, and which terminates at the apex of the obtuse angle of the front edge.

In a modification, each plate in the stack has a boss which extends outwardly and in the direction of alignment of the communication apertures. The front edge of the plate may be rectilinear, and may then make abutment against a projecting element of the front face of the casing. The boss of each said plate is preferably joined to a lip which surrounds one of the two said communication apertures, the said lip being itself connected to a further lip which surrounds the central hole of the plate, with a central tube of the heat exchanger extending through the central holes and coaxially on the stacking axis. Preferably, then, each plate further includes another lip surrounding the other communication aperture.

A preferred embodiment of the invention will now be described, by way of example only and with reference to the accompanying drawings.

BRIEF DESCRIPTION OF THE DRAWINGS

FIG. 4 is a perspective view showing part of two corrugation lines of the perturbator element.

FIG. 5 is a top plan view of one plate of the heat exchanger.

DESCRIPTION OF A PREFERRED EMBODIMENT OF THE INVENTION

Figure 1:
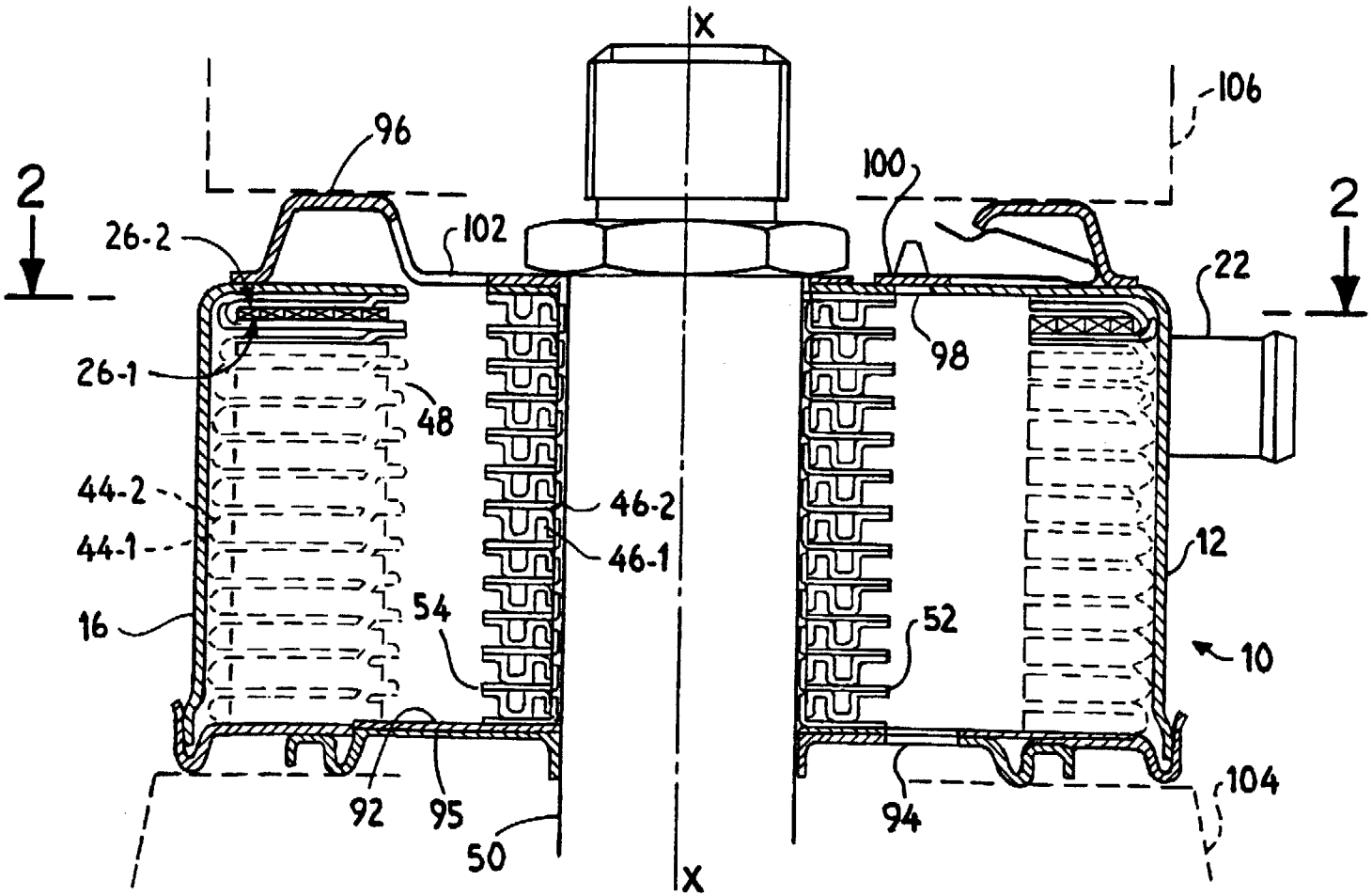
FIG. 1 is a view in longitudinal cross section of a plate type heat exchanger in accordance with the invention, with the cross section being taken on a plane passing through the axis of the stack.
Figure 2:
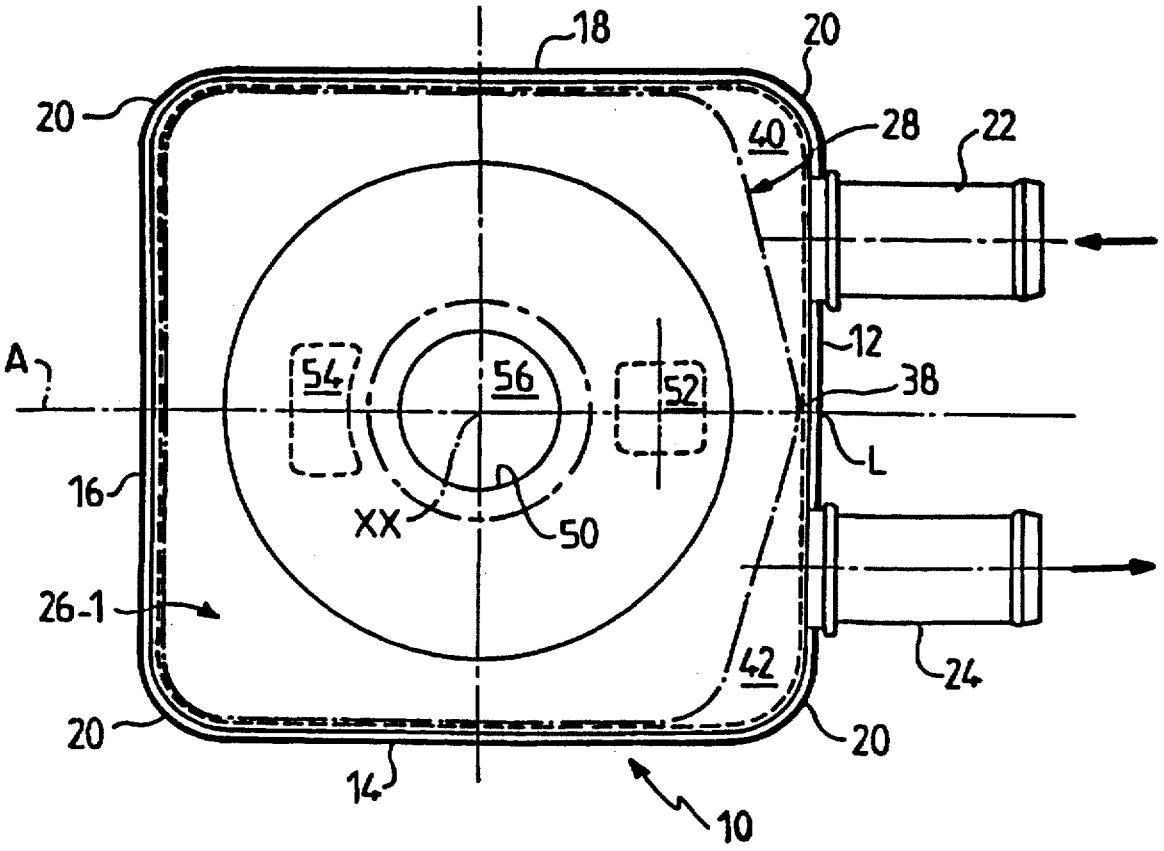
FIG. 2 is a view in cross section on a smaller scale, taken on the line II—II in FIG. 1.

The plate type heat exchanger shown in FIGS. 1 and 2 comprises a casing 10 which is delimited by a cylindrical envelope having a substantially square cross section. The generatrices of this cross section are parallel to an axis XX. The envelope of the casing is limited by four flat lateral faces 12, 14, 16 and 18 which are all substantially rectangular in shape, and which are joined together in pairs through two rounded faces 20, best seen in FIG. 2. The face 12 is an attachment face, and has an inlet tube branch 22 and an outlet tube branch 24 for a fluid. In this example this fluid is the cooling liquid for a heat engine of a motor vehicle. The two tube branches 22 and 24 are open respectively into two symmetrical portions of the attachment face 12, and they lie on either side of a median line L which is parallel to the axis XX (again see FIG. 2).

The heat exchanger also includes a stack of plates 26 which are arranged in pairs 26-1 and 26-2, in alternating relationship within the casing 10, extending in the direction of the axis XX, which can thus be considered as being the stacking axis on which the plates 26 are stacked. The two plates 26-1 and 26-2 (which may be referred to as "half plates") of any one pair of plates, are substantially identical to each other, as can be seen in FIG. 1.

Each plate 26-1, i.e. the lower plate of each pair, is substantially in the form of a square, but is delimited by a non-rectilinear front edge 28 and three other edges 30, 32 and 34, all of which are straight. This is best seen in FIG. 5. The edges 28, 30, 32 and 34 are joined together through four rounded corners 36.

The front edge 28 consists of two straight portions 28-1 and 28-2, which are joined together through an obtuse angle, the apex 38 of which is in abutment against the attachment face 12 where it intersects the median line L of the latter shown in FIG. 2. It will be understood that the dimensions of the plates 26 are slightly smaller than the internal dimensions of the casing, so that the plates can be fitted within the casing.

In this way, two compartments 40 and 42 (FIG. 2) are defined within the casing. These compartments are in communication with the inlet tube branch 22 and outlet tube branch 24 respectively.

Each lower plate 26-1 is also provided with an external collar portion 44-1, which receives a matching external collar portion 44-2 of the associated upper plate 26-2 of the pair. The plate 26-1 also has an internal collar portion 46-1, which is circular and which receives a matching internal collar portion 46-2 of the corresponding plate 26-2. This is best seen in FIG. 1. When the two plates 26-1 and 26-2 of each pair are nested together with their matching collar portions fitted together, they define between them a flow passage 48 for a first fluid, which in this example is lubricating oil which is to be cooled in the heat exchanger by the above mentioned second fluid.

The stack of plates 26 is inserted into the casing 10 about a central tube 50, against which the internal collar portions 46-2 are engaged.

In order to provide a path for the flow of oil from one pair of plates to another, that is to say from one flow passage 48 to another, each plate 26 has two diametrically opposed communication apertures, namely an inlet aperture 52 and an outlet aperture 54. These two apertures are arranged on either side of the stacking axis XX, and lie in aligned relationship in a direction A parallel to the two sides 30 and 34 of the plates 26 (see FIG. 5). The direction A is also parallel to the sides 14 and 18 of the casing, as shown in FIG. 2.

Each of the plates 26 also has a circular central hole 56 for accommodating the central tube 50. Each of the plates 26 has a peripheral lip 58, of circular form, which surrounds the hole 56 and which is joined to a peripheral lip 60 of generally rectangular shape. This peripheral lip 60 surrounds the inlet aperture 52 of the plate. A boss portion 62, joined to the peripheral lip 60, extends in the alignment direction A of the apertures 52 and 54, and terminates at the apex 38 of the obtuse angle of the front edge 28, as can be seen in FIG. 5. In addition, each of the plates 26 has a further lip 64, of generally rectangular shape, which surrounds the outlet aperture 54 of the plate (see FIG. 5). The various lips are formed in relief on each of the plates 26-1 and each of the plates 26-2, so as to extend outwardly. Thus, when the pairs of plates are stacked together, the lips provide sealing for the communication between each pair of plates and the next, in particular at the level of the inlet and outlet apertures 52 and 54. In addition, the bosses 62 make contact with each other and thereby delimit within the casing two regions which communicate with the compartments 40 and 42 respectively. The coolant fluid entering via the tube branch 22 thus flows into the assembly of the plates 26, so as eventually to leave via the outlet tube branch 24.

The two plates 26-1 and 26-2 of any one pair are joined together by brazing together of their respective collars, and each pair of plates is secured to the next by brazing of their respective lips 58, 60 and 64 and their respective bosses 62.

As is best seen in FIGS. 2 and 5, the communication aperture 52 for inlet of the oil is substantially square in shape, having sides parallel to the sides of the square of the plate. The communication aperture 54 which serves as a fluid outlet is also generally rectangular in shape, with the larger dimension of the rectangle extending transversely to the alignment direction A of the two communication apertures. The square or rectangular shapes of the apertures 52 and 54 facilitate spreading of the oil into each of the flow passages 48, while favouring two directions of flow at right angles to each other.

Figure 3:
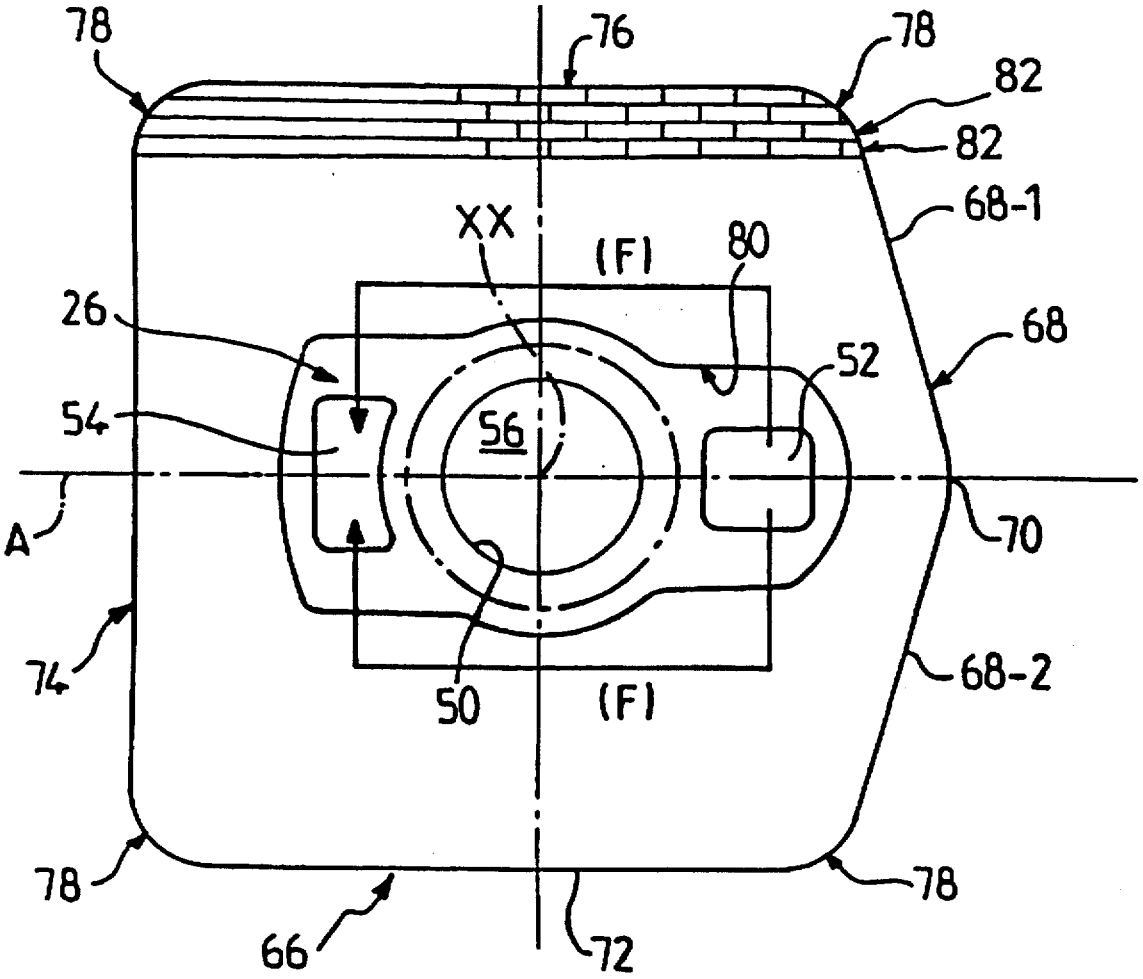
FIG. 3 is a top plan view of a perturbator element.

The heat exchanger also includes a multiplicity of perturbator elements 66 which are fitted within the oil flow passages 48. FIG. 3 shows one of these perturbator elements. It is a single component in the form of a pressing, having a generally square shape matching that of the plates 26. Each perturbator plate 66 has a front edge 68 comprising two straight portions 68-1 and 68-2, which are joined together through an obtuse angle 70, together with three other straight sides 72, 74 and 76. The four sides of the perturbator plate are joined together through rounded portions 78. The plate 66 also has a central hole 80 of elongated shape, the edge of which surrounds the communication apertures 52 and 54 and the central hole 56 of the plates 26.

In addition, each perturbator plate 66 is formed with a large number of corrugation lines 82 which define fins. These lines 82 extend parallel to the alignment direction A of the apertures in the plates 26, as can be seen in FIG. 3. The corrugation lines are formed in relief by pressing.

As can be seen in FIG. 4, the corrugations in the lines 82 have a form which is similar to a sine curve, but they are formed of flat segments 84 lying in a common plane, together with further flat segments 86 lying in another common plane parallel to the first, and intermediate segments 88 which join the segments 84 to the segments 86. The intermediate segments 88 define an obtuse angle with the segments 84, and the same obtuse angle with the segments 86. In addition, as can be clearly seen in FIG. 4, the corrugations in each line 86 are staggered longitudinally with respect to those in the next adjacent line 82.

As is indicated diagrammatically by the arrows F in FIG. 3, the oil entering into one flow passage 48 through an inlet aperture 52 is able to pass to the periphery of the flow passage, by flowing over all of the corrugation lines 82, and without being retarded by these latter. This reduces the loss of energy inherent in the flow path, and also encourages good heat exchange with the coolant liquid. The oil, cooled in this way, is then readily able to flow out through the outlet apertures 54.

Referring again to FIG. 5, each of the plates 26 is formed with a multiplicity of pips 90 which project inwardly, and which act as spacers for maintaining the perturbator element 66 spaced away from the two plates 26-1 and 26-2 on either side of it.

As shown in FIG. 1, the heat exchanger has an annular base 92 which is formed with an aperture 94 lying in line with the apertures 52, so as to constitute the inlet through which oil enters the heat exchanger. The base 92 is retained by a seal-carrying pedestal plate 95, which is disposed between the envelope of the casing and the central tube 50. At its other end, the heat exchanger has a seal-carrying top plate 96 which is connected to the envelope of the casing and to the central tube 50. This top plate includes a bypass port 98 which lies in axial alignment with the apertures 52. The bypass port 98 is a hole which is covered by a flap valve 100 for controlling opening of the bypass port 98. The top plate 96 also has an opening 102 which is arranged in alignment with the outlet apertures 54.

The heat exchanger is arranged to be fixed on an engine block 104, and to receive an oil filter 106. The heat exchanger is secured on the engine block 104, and the oil filter 106 is secured on the heat exchanger by means of, for example, a hollow threaded bar.

The heat exchanger operates in the following way. When the oil is cold and viscous, it penetrates into the heat exchanger through the oil inlet aperture 94. The high viscosity of the cold oil causes the pressure to rise, and this causes the flap valve 100 to open. The oil therefore passes directly through the heat exchanger from the inlet aperture 94 to the bypass port 98, via the inlet apertures 52. The oil then passes through the filter and returns to the engine block 104 through the central tube 50.

When on the other hand the oil is hot and fluid, the flap valve 100 is closed. The oil is then distributed into each flow passage 48 through the apertures 52, and it leaves these flow passages via the outlet apertures 54, so as to pass then to the opening 102. From there it is taken to the filter 106, from whence it returns to the engine block through the central tube 50.

In this way the heat exchanger provides optimised heat exchange between the oil to be cooled and the coolant liquid, with a minimum amount of energy loss in the process.

The invention is of course not limited to a heat exchanger for use as an oil cooler.

What is claimed is:

1. A plate type heat exchanger for effecting heat transfer between a first fluid and a second fluid, comprising a casing defining an inlet and an outlet for the first fluid, for flow of the second fluid through the casing, and a stack of plates disposed within the casing and defining a stacking axis, with the plates of each pair defining between them a flow passage for the first fluid, each plate being formed with two communication apertures through which the first fluid can flow between the plates in a path from said first fluid inlet to said first fluid outlet, and further having perturbator elements arranged in said flow passages, wherein each said plate is substantially square, with said communication apertures being arranged on either side of said stacking axis to establish an alignment direction for said apertures parallel to two sides of said square, and wherein each perturbator element has a plurality of adjacent lines of corrugations forming fins that extend in a direction parallel to said alignment direction, wherein the casing is of substantially square cross section delimited by four flat, substantially rectangular, lateral faces, wherein one of said four lateral faces of the casing is an attachment face, the heat exchanger further having an inlet tube branch and an outlet tube branch for the second fluid, said tube branches being carried by said attachment face, said attachment face establishing a median line parallel to the stacking axis and having two symmetrical portions of the attachment face on either side of said median line, said two tube branches being open respectively into said two portions of said attachment face, and wherein each said plate has a non-rectilinear front edge on the same side as said attachment face, said front edge having two straight portions joined together through an obtuse angle to form an apex in abutment against said attachment face on said median line.

2. A heat exchanger according to claim 1, wherein each said corrugation comprises flat segments joined together through an obtuse angle.

3. A heat exchanger according to claim 1, wherein the corrugations of each said line of corrugations are staggered with respect to those in the next said adjacent line.

4. A heat exchanger according to claim 1, wherein each perturbator element is a generally square component in the form of a pressing having an elongate central aperture.

5. A heat exchanger according to claim 1, wherein said two communication apertures in each said plate are rectangular, with sides thereof generally parallel to the sides of the plate.

6. A heat exchanger according to claim 5, wherein, in each said plate, one said communication aperture is square and provides an inlet for the first fluid, the other communication aperture is rectangular and provides an outlet for the first fluid, with the larger dimension of said outlet rectangle extending transversely to the alignment direction of said two communications apertures.

7. A heat exchanger according to claim 1, wherein each said plate has a boss extending outwardly in said alignment direction, said bosses terminating at said apex of the obtuse angle of the front edge of each said respective plate.

8. A heat exchanger according to claim 1, wherein each said plate has a boss extending outwardly in said alignment direction.

9. A heat exchanger according to claim 8, wherein each said plate has a central hole, the heat exchanger further comprising a central tube passing through said central plate holes coaxially with said stacking axis, each said plate further having a first lip joined to said boss of said plate and surrounding one of said two communication apertures therein, and a second lip joined to said first lip and surrounding said central plate hole.

10. A heat exchanger according to claim 9, wherein each said plate further includes a third lip surrounding the other said communication aperture.

* * * * *